United States Patent [19]

Aschenbach

[11] 4,370,528

[45] Jan. 25, 1983

[54] MINIATURE SEALED TOGGLE SWITCH

[75] Inventor: Louis F. Aschenbach, Menomonee Falls, Wis.

[73] Assignee: Eaton Corporation, Cleveland, Ohio

[21] Appl. No.: 243,687

[22] Filed: Mar. 16, 1981

[51] Int. Cl.[3] ..... H01H 21/04

[52] U.S. Cl. ..... 200/6 BB; 200/67 G; 200/302

[58] Field of Search ..... 200/6 R, 6 B, 6 BA, 200/6 BB, 67 G, 302, 339, 293

[56] References Cited

U.S. PATENT DOCUMENTS

| | | | |
|---|---|---|---|
| 3,483,345 | 12/1969 | Hults | 200/302 |
| 3,715,534 | 2/1973 | Piber | 200/67 G |
| 4,259,552 | 3/1981 | Swann | 200/6 R |
| 4,308,434 | 12/1981 | Roeser | 200/6 R |

*Primary Examiner*—A. T. Grimley
*Assistant Examiner*—Morris Ginsburg
*Attorney, Agent, or Firm*—C. H. Grace; W. A. Autio

[57] ABSTRACT

A miniature sealed toggle switch having a housing (2,4) that is sealed by a gasket (16) sealed to the toggle lever by a groove (**12*b*) and RTV (18) and to the housing by a ridge (16*d*) and a tapered edge (2*e*) on the base, and by two grooves (6*d*, 6*e*, FIG. 3) on the terminals that prevent leaks under different expansion of the metal terminals (6) and the molded base (2*a*, 2*b*, FIG. 3). Contactor erosion is reduced by a drop (26*d*) on the contactor causing arc movement on opening. Grooves (2*g*, 2*h*) and arc shields (2*f*) in the base prevent formation of conductive paths. A stepped taper (12*d*) on the toggle lever and a tapered hole (28*a*) reduce wear. Nickel plating of the brass lever (12) and aluminum bushing (4*a*) insure ground of the lever. The contactor configuration (32*c*, 32*d*, FIG. 5), clearance between the toggle lever and actuator, and energy storage in conical spring (30) provide non-stall, non-tease operation. The radius of the actuator tips (28*c*) are maintained by the radius (32*a*, 32*b*, FIG. 5) in the contactor over a time period. Non-teasable momentary action with reduced bounce is provided by spring-biased plungers (36) with controlled clearance relative to the actuator slots, conical spring (30) and contactor (42, FIG. 6) configuration with energy storage points (42*d*, 42*e*). Two-way momentary action is provided by two pairs of plungers (36, 44, FIG. 8). Non-tease operation is provided by the pivot (26*h'*, FIG. 11) of contactor suspension being above the decision point (26*j'*, FIG. 11) of the contactor. Minor modification (26*g'*, FIG. 11, 96*c*, FIG. 14*a***) provide ON-ON-ON operation. A common metal bushing may be used with different sizes of molded cover portion.

20 Claims, 20 Drawing Figures

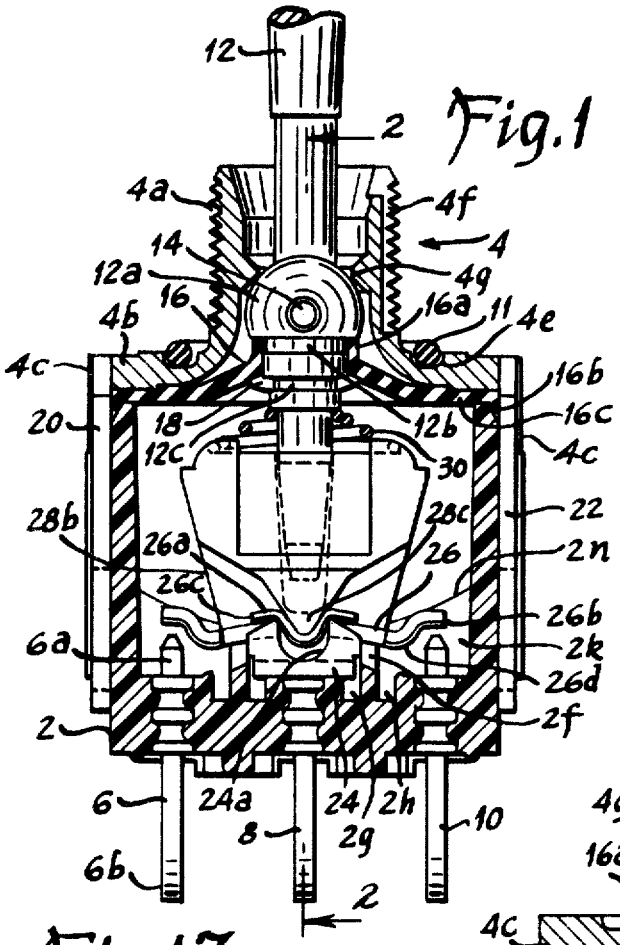
Fig.1
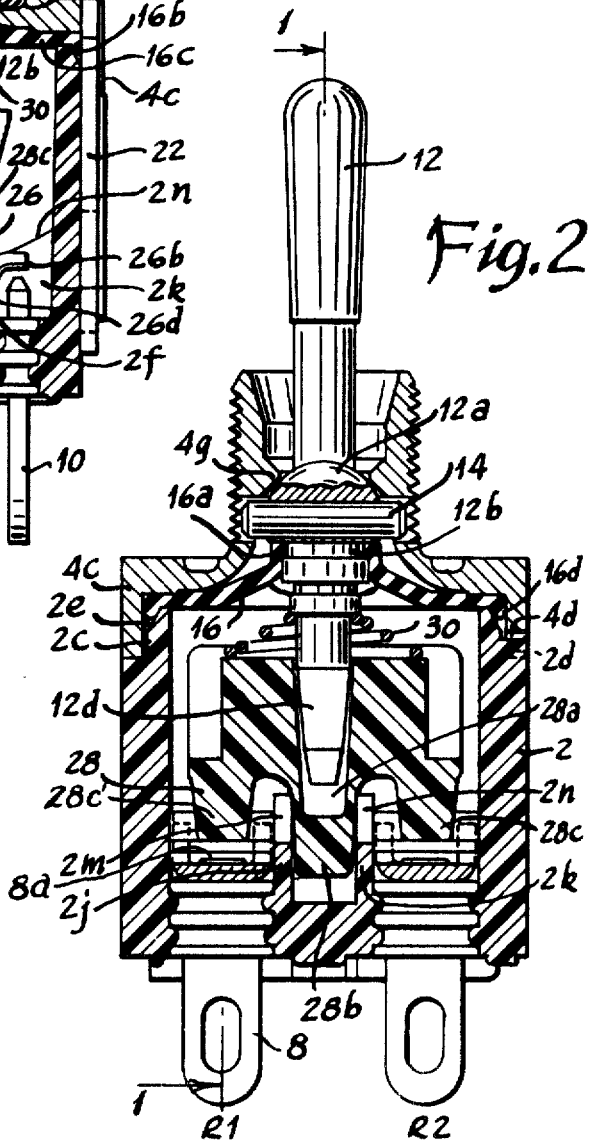
Fig.2
Fig.17
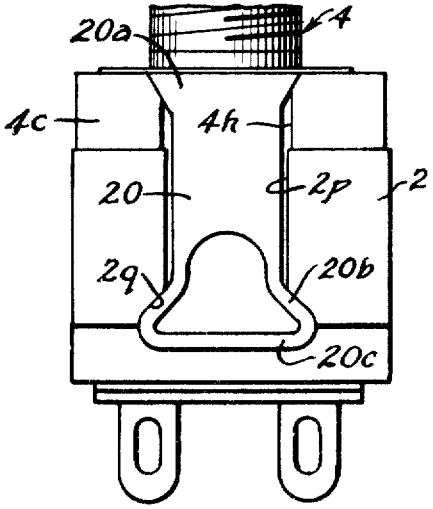

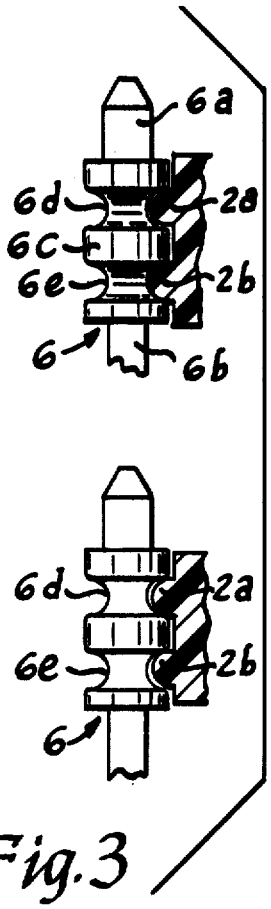
Fig.3
Fig.4
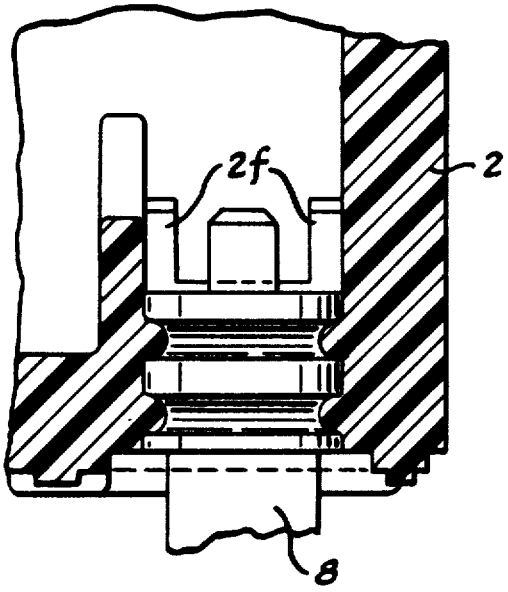
Fig.5
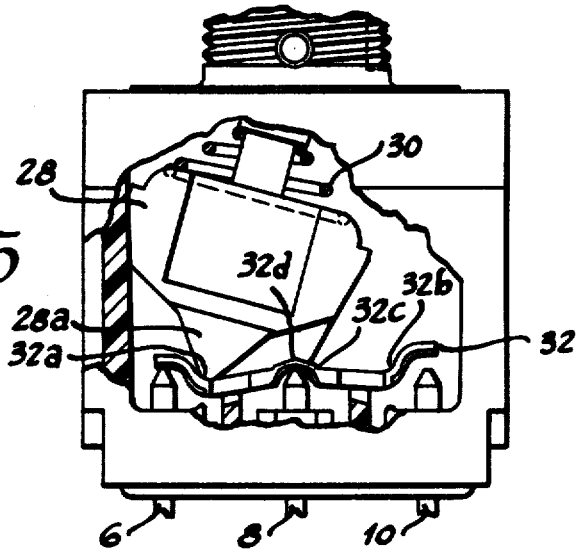

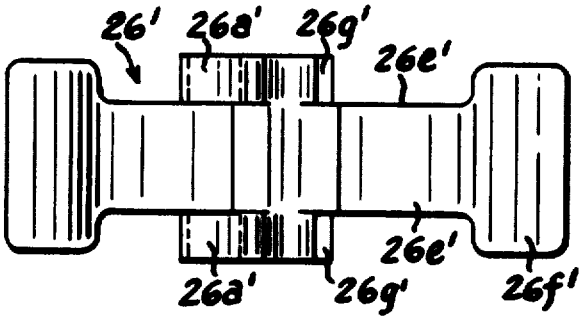
Fig.10
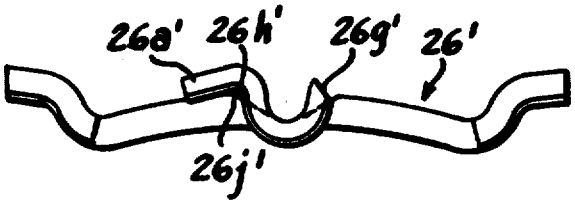
Fig.11
Fig.12
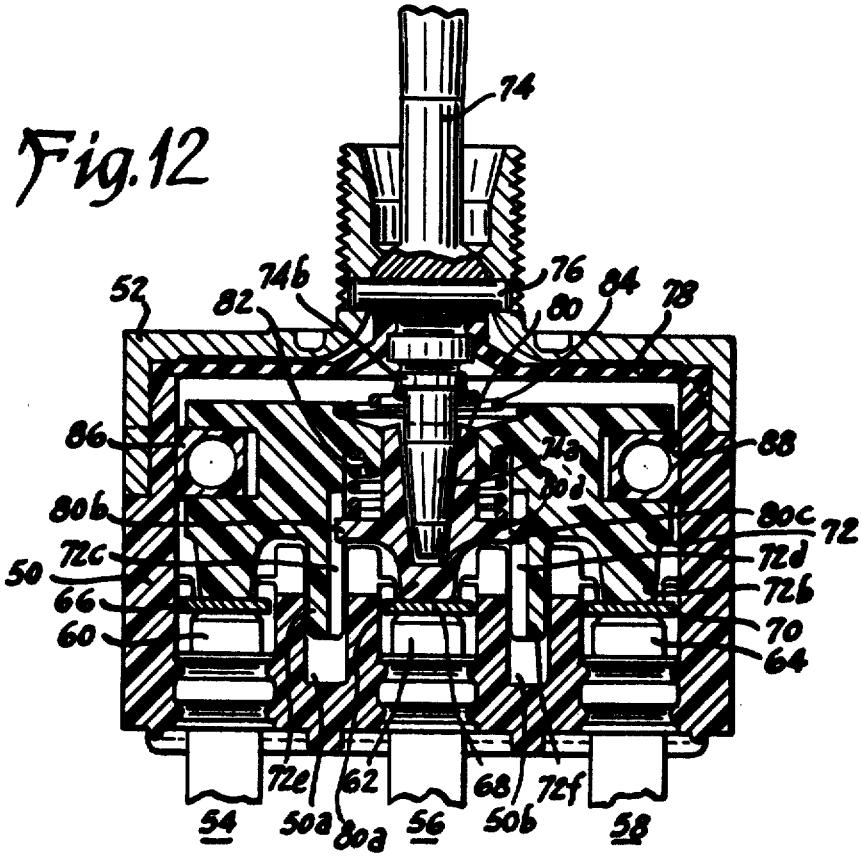

Fig.13
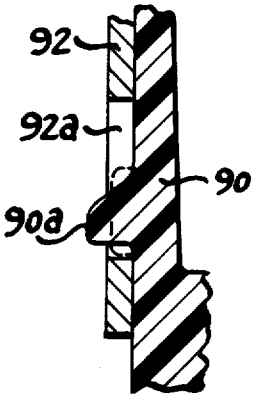
Fig.14
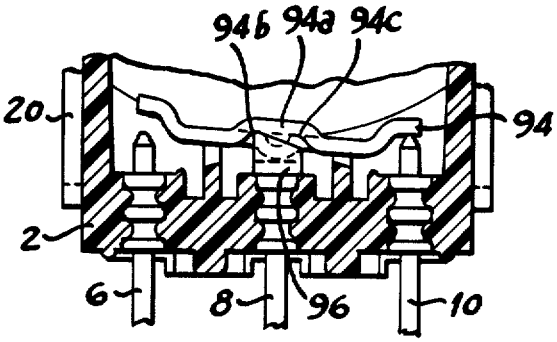
Fig.14a
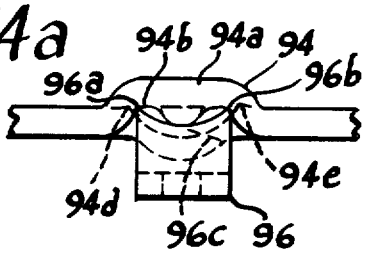
Fig.15
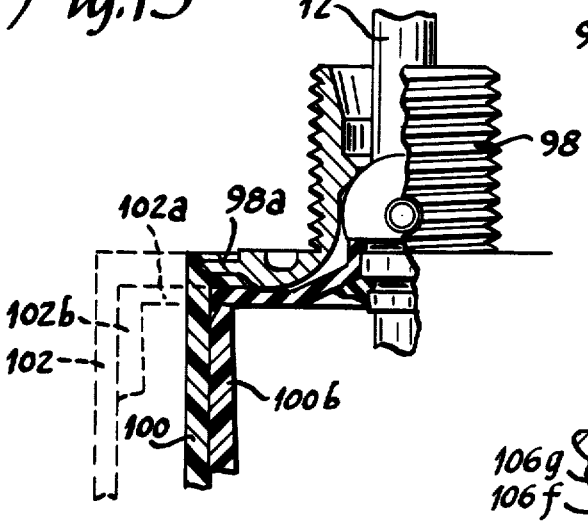
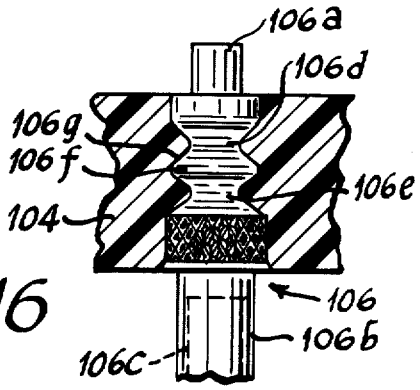
Fig.16

MINIATURE SEALED TOGGLE SWITCH

BACKGROUND OF THE INVENTION

Miniature sealed toggle lever switches have been known heretofore. For example, H. W. Brown U.S. Pat. No. 3,350,521, dated Oct. 31, 1967, and H. W. Hults U.S. Pat. No. 3,636,286, dated Jan. 18, 1972, show miniature toggle lever switches, the latter patent showing a sealed type switch. While these prior switches have been useful for their intended purpose, this invention relates to improvements thereover.

SUMMARY OF THE INVENTION

An object of the invention is to provide an improved miniature toggle lever switch.

A more specific object of the invention is to provide an improved environmentally sealed toggle lever switch.

Another specific object of the invention is to provide an improved lever seal for a miniature toggle lever switch.

Another specific object of the invention is to provide an improved terminal structure that maintains the terminal sealed under temperature changes.

Another specific object of the invention is to provide a toggle lever switch with improved shielded contact structure that reduces contact erosion and enhances contact life and prevents arc products from forming conductive paths between the contacts.

Another specific object of the invention is to provide a toggle lever switch with improved operating means that minimizes wear, thus providing constant operating characteristics such as feel and bounce over a long life.

Another specific object of the invention is to provide the toggle lever of a toggle lever switch with improved grounding means.

Another specific object of the invention is to provide a toggle lever switch with improved contact structure and operating mechanism that affords none-stall none-tease operation.

Another specific object of the invention is to provide a toggle lever switch with improved momentary operating structure that affords non-teasable action with low bounce.

Another specific object of the invention is to provide a toggle lever switch with improved means affording "full-throw momentary" operation, or "ON-OFF-MOMENTARY ON" operation, or "MOMENTARY ON-OFF-MOMENTARY ON" operation.

Another specific object of the invention is to provide a toggle lever switch with improved means affording non-tease "ON-OFF-ON" operation.

Another specific object of the invention is to provide a toggle lever switch with improved means affording "ON-ON-ON" operation.

Another specific object of the invention is to provide a toggle lever switch with improved means affording "ON-NONE-ON" operation;

Another specific object of the invention is to provide a toggle lever switch with improved means affording "ON-NONE-MOMENTARY-ON" operation.

Another specific object of the invention is to provide a toggle lever switch with three-pole and four-pole contact actuator means affording self-equalizing of the contact forces with respect to the third and fourth poles.

Another specific object of the invention is to provide a toggle lever switch with improved means for assembling and retaining the switch cover to the base.

A further specific object of the invention is to provide a toggle lever switch with improved bushing and cover structure affording use of a common bushing with a plurality of different size covers.

Other objects and advantages of the invention will hereinafter appear.

BRIEF DESCRIPTION OF THE DRAWINGS

FIG. 1 is an enlarged vertical longitudinal cross-sectional view of a miniature double-pole environmentally sealed switch constructed in accordance with the invention and showing the operating mechanism and one pole of the double-pole switch;

FIG. 2 is a vertical lateral cross-sectional view of the switch of FIG. 1 showing the operating mechanism and both poles of the double-pole switch;

FIG. 3 is a fragmentary cross-sectional view of one terminal of the switch of FIG. 1 showing effectiveness of the seal under both high temperature and low temperature conditions;

FIG. 4 is an enlarged fragmentary view of the lower right portion of FIG. 2 with the actuator block and contactor removed to show the arc shield integrally molded with the base;

FIG. 5 is an enlarged elevational view of a miniature toggle lever switch with a part of the housing broken away to show an ON-NONE-ON version of contact operation;

Figure 6:
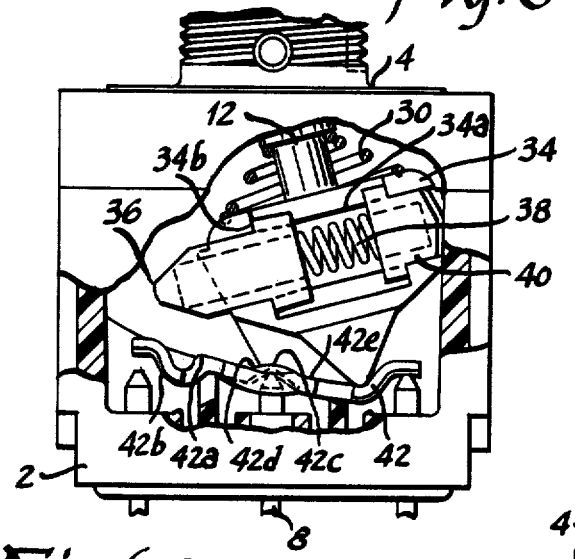
FIG. 6 is a view like FIG. 5 showing an ON-NONE-MOM. ON version of contact operation.
Figure 7:
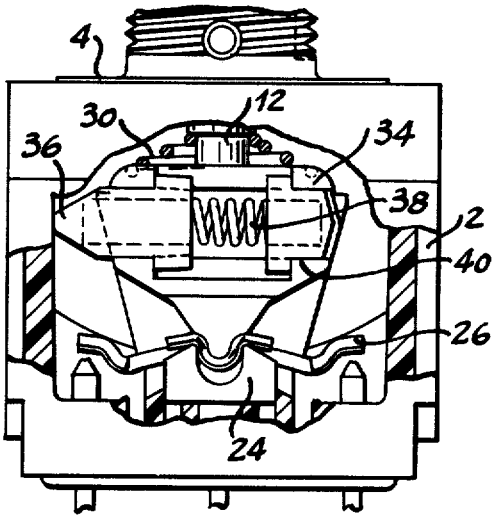
Figure 8:
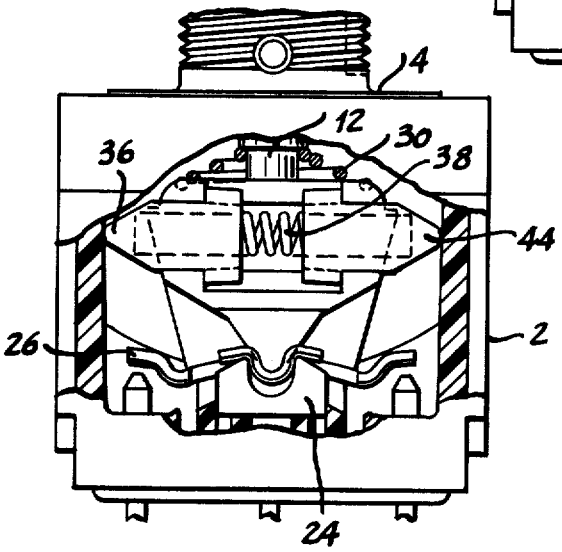
Figure 9:
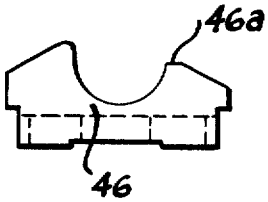

FIG. **6*a*–6*b* show the momentary plunger of FIG. 6**;

FIG. 7 is a view like FIGS. 5 and 6 showing an ON-OFF-MOM. ON version of contact operation;

FIG. 8 is a view like FIGS. 5–7 showing a MOM. ON-OFF-MOM. ON version of contact operation;

FIG. 9 is an enlarged elevational view of a modified contact support usable in the switch of FIGS. 1 and 2 to afford ON-ON-ON operation;

FIG. 10 is an enlarged top view of a modified contactor usable in the switch of FIGS. 1 and 2 to afford ON-ON-ON operation as an alternative to the modified contact support of FIG. 9;

FIG. 11 is a side view of the contactor of FIG. 10;

FIG. 12 is an enlarged vertical lateral cross-sectional view of a miniature 3-pole environmentally sealed switch constructed in accordance with the invention and showing the self-leveling operating mechanism;

FIG. 13 is an enlarged fragmentary cross-sectional view through one side of the base and cover of a switch showing modified means for securing the cover to the base;

FIG. 14 is an enlarged vertical longitudinal view through the lower portion of a switch base showing a modified contact carrier and contact providing ON-ON-ON operation;

FIG. **14*a* is a fragmentary view showing a modification of FIG. 14**,

FIG. 15 is an enlarged partial cross-sectional view of the upper portion of a switch showing use of like bushings with a plurality of different size covers for single-pole, double-pole, 3-pole, 4-pole, etc. toggle lever switches;

FIG. 16 is an enlarged fragmentary cross-sectional view showing a modified terminal construction.

FIG. 17 is a reduced, partial left end elevational view of the switch of FIG. 1 showing the cover skirt and one of the cover ties which clamp the cover to the base.

DESCRIPTION OF THE PREFERRED EMBODIMENTS

Referring to FIGS. 1 and 2, there is shown a miniature sealed toggle lever switch constructed in accordance with the invention. While this switch construction is adapted for both single-pole and double-pole versions with minimum substitution of parts such as the housing and actuator, a double-pole version is shown for illustrative purposes.

This switch construction is also adapted for 3-pole and 4-pole versions with certain modifications as hereinafter described, the 3-pole version being shown in FIG. 12 for illustrative purposes.

As shown in FIGS. 1 and 2, this switch is provided with a housing comprising a rectangular cup-shaped insulating base 2 molded of plastic molding material such as general purpose phenolic or the like and a metal cover 4 of aluminum or the like. This base is provided with two rows, R1 and R2, of terminals as shown in FIG. 2 with three terminals in each row as shown in FIG. 1 molded in the bottom of the base. Each such row of terminals includes a left terminal 6, a center terminal 8 and a right terminal 10. These terminals are molded in and extend through the bottom of the base to provide a stationary contact such as 6*a* at one end within the base and an external terminal portion such as 6*b* at the other end outside the base for connection to an external circuit.

These terminals are provided with means for maintaining them sealed to the base under variable temperature conditions. Using terminal 6 as an example, this means comprises an enlarged oblong portion 6*c* having two spaced semi-circular grooves 6*d* and 6*e* therearound in that intermediate part of the terminal that is embedded in the bottom of the base as shown in FIGS. 1 and 3. As shown at the upper portion of FIG. 3, under high temperature conditions, the base material expands more than the terminal material so that ridges 2*a* and 2*b* of the base become pressed tightly against the upper side of groove 6*d* and the lower side of groove 6*e*, respectively, all around because the sides of the grooves diverge. This maintains a good seal in a hot environment which would not be the case if there were more or less than two grooves in the terminal. As shown at the lower portion of FIG. 3, under low temperature conditions, the base material contracts more than the terminal material so that ridges 2*a* and 2*b* of the base become pressed tightly against the lower side of groove 6*d* and the upper side of groove 6*e*, respectively. This again maintains a good seal in a cold environment which would not be the case if there were more or less than two grooves in the terminal. Cover 4 is provided with an externally threaded upstanding bushing 4*a* having at its lower end an integral generally flat cover plate 4*b* for closing the top of the base and having a short skirt 4*c* at its outer periphery fitting into a corresponding notch 2*c* around the top of the base as shown in FIG. 2. A locating notch 4*d* in this skirt at one side of the cover matches a corresponding bump 2*d* in the base as shown in FIG. 2 to correctly position the toggle lever with respect to desired contact operation. A circular groove 4*e* in the cover plate retains an O-ring 11 as shown in FIG. 1 and the bushing is provided with a keyway 4*f* to adapt the switch for mounting in a hole in a panel.

This bushing has means for pivotally mounting a toggle lever 12. For this purpose, the bushing has a constriction 4*g* therewithin up against which a spherical portion 12*a* of the toggle lever is seated as shown in FIGS. 1 and 2 to substantially close the bushing against entry of any large particles. An anti-rotation pivot pin 14 extends through this spherical portion as well as opposite holes in the bushing to pivot the toggle lever in the bushing for limited reciprocal movement. This pivot pin is short enough so that it will not interfere with assembly of a washer and nut on the bushing when the switch is secured to a panel in one hole mounting (O.H.M.) fashion. The toggle lever which is preferably made of passivated stainless steel or brass and the bushing that is preferably made of aluminum are nickel plated to insure that the lever is grounded through the bushing to the mounting plate.

The toggle lever is sealed to the cover to prevent entry of dirt, water, or the like into the switch compartment within the base. For this purpose, a seal or gasket 16 made of silicone rubber or the like extends between the toggle lever and the housing. As shown in FIGS. 1 and 2, this gasket has a collar portion 16*a* that surrounds and grips an annular groove 12*b* in the spherical portion of the toggle lever directly below the pivot pin. Spaced slightly downwardly from groove 12*b* is another annular groove around the toggle lever and this groove as well as the joint between the toggle lever and gasket is filled with an RTV (room temperature vulcanizing) sealant 18. This gasket has a low frusto-conical shape 16*b* below its collar 16*a* that leads into a flat horizontal portion 16*c* having a bead or ridge 16*d* around its lower surface periphery that enhances clamping and retaining of the gasket in place. As shown in FIG. 2, the upper edge of the base has a bevel 2*e* from notch 2*c* to the top of the base. This bevel tends to hold the gasket in place when assembled and also tends to stretch the gasket when the cover is clamped on the base to minimize inward or downward deflection of the gasket at lower temperatures. Skirt 4*c* on the cover stops against the bottom of notch 2*c* when the cover is assembled to the base to limit the clamping force on the periphery of the gasket. Heat is applied to this subassembly in an oven to speed up curing of the RTV sealant and to shrink the gasket collar around the toggle lever.

Sealant 18 is preferably General Electric RTV 560 silicone adhesive-sealant. This adhesive-sealant contains silicone and bonds to the silicone rubber gasket and to the primed metal toggle lever thereby to provide a good hermetic seal between the gasket and the toggle lever. Also, this adhesive-sealant does not produce corrosive byproducts when heat is applied during curing thereof, it is not easily permeable to gases and thus will not produce gases in the switch, it has excellent low temperature flexibility, it is non-sagging, and it adheres through a wide temperature range such as minus 65 degrees C. to plus 200 degrees C. This adhesive-sealant adheres directly to the gasket whereas primer is preferably used to prepare the surface of the metal toggle lever for good adhesion.

The cover is clamped onto the base in a conventional manner. For this purpose, a pair of like cover ties 20 and 22 are provided as shown in FIGS. 1 and 17. While not shown in detail, these cover ties are two flat metal members of stainless steel or the like having an outwardly flared Y-shaped upper end 20*a* and a loop 20*b* at the lower end originally formed by a round end and an oblong perforation. The cover has an upwardly flared slot 4h in skirt 4c at each end and the base has a channel 2p ending in a downwardly flared slot 2q at each end. The cover ties 20 are hooked onto the cover slots and the loops thereof are formed at 20c to spread into the downwardly flared slots of the base this forming being similar to that shown in H. W. Brown U.S. Pat. No. 4,110,585, dated Aug. 29, 1978 to securely clamp the cover to the base.

As shown in FIG. 1, center terminal 8 of each pole of the switch is provided with a contactor support 24 riveted to its upper end 8a within the base as shown in FIG. 2. This contactor support is generally U-shaped as shown in FIG. 2 and has a pair of rounded slots 24a in its sides as shown in FIG. 1. The upper edges on opposite sides of each such slot 24a are angled outwardly and downwardly to provide a pair of pivot points for supporting the pair of wings of a contactor 26. As will be apparent, contactor 26 has two pairs of wings 26a, one pair on each side, resting on the respective pair of pivot points of the contactor support and a center depression to hold the contactor in off position when the toggle lever is in center position as shown in FIG. 1.

This contactor is formed to provide improved switch action. For this purpose, this contactor is formed with a symmetrical recess at the respective center into which the tip 28c or 28c' of actuator 28 is biased by frusto-conical spring 30 when the switch is in off position as shown in FIG. 1. The end portions of the contactor are provided with good electrically conducting inlaid material 26b such as silver and cadmium oxide. The center portion of this contactor including the wings are provided with similar inlaid material 26c or alternatively with coin silver. Each end portion of this contactor directly inwardly of the contacting point is provided with a formed "drop" 26d that enhances the life of the contactor. To this end, this drop functions upon opening of the contacts as an arcing area independent of the normal arc gap to cause less erosion of the contactor surface thus providing longer electrical life and maintenance of mechanical characteristics of "feel" and operating force. It will be apparent that when the contactor opens, any arc that is drawn will run down to this drop thus reducing erosion at the contact point.

This switch is also provided with means to maximize insulation resistance by preventing arcing products from depositing conducting paths on the insulating base. For this purpose, base 2 is provided with U-shaped arc shields 2f, one of whch is shown in FIG. 4. There are two of these arc shields for each contactor, one between terminals 6 and 8 and the other between terminals 8 and 10. This arc shield hugs the narrow portion like narrow portion 26c' of the contactor, FIG. 10, between the wings and the T-shaped contacting tip 26f'. These arc shields are molded integrally with the base. In addition, there are grooves 2g and 2h in the bottom of the base, one on each side of each arc shield 2f as shown in FIG. 1. As will be apparent in FIG. 1, the contactor drop 26d along with arc shield 2f and grooves 2g and 2h provide "shadow" areas that are shielded from direct line receipt of arcing products thereby to prevent deposit of continuous arcing paths on the insulating base. For example, drop 26d in FIG. 1 confines the flow of arcing products downwardly to the left. The right hand shoulder of groove 2h blocks these arcing products from coating the right-hand portion of groove 2h. The bottom of U-shaped shield 2f blocks direct flow of arcing products into groove 2g. These grooves also lengthen the insulating path between the stationary contacts of terminals 8 and 10.

The contact actuator mechanism is provided with means to minimize wear, thus providing contant operating characteristics such as feel and bounce throughout the long life of the switch. For this purpose, actuator 28 which is molded of plastic material is provided with a tapered hole 28a as shown in FIG. 2 and the lower end portion of the toggle lever is provided with a stepped taper 12d which provide a large bearing surface therebetween when the toggle lever is actuated thereby to minimize wear.

As shown in FIG. 2, actuator 28 is guided for longitudinal swinging movement within the base. For this purpose, the double-pole actuator is provided with a laterally flat central downward projection 28b as shown in FIGS. 1 and 2 that slides between and is guided by a pair of spaced walls 2j and 2k extending part-way up from the bottom of the base. These walls have arcuate upper edges 2m and 2n to provide clearance for the swinging movement of the actuator when the toggle lever is pivotally operated.

The contact actuator mechanism is also provided with means affording non-stall, none-tease ON-NONE-ON operation. This means comprises the combination of features shown in FIG. 5 including the contactor 32 configuration, the predetermined clearance between lower end portion 12d of the toggle lever and tapered hole 28a in the actuator, the energy storage in shear in frusto-conical compression spring 30, and the radius of the actuator tip 28c that is maintained constant over a long time period by being pressed into the like radius of the recess 32a or 32b at either end portion of contactor 32 shown in FIG. 5.

As shown in FIG. 5, contactor 32 rests on the upper tip of terminal 8, there being no contactor support riveted to such tip as in FIG. 1. The contactor configuration comprises a small step 32c on each side of the fulcrum on the upper surface of the contactor and a sharp-cornered apex 32d therebetween. This sharp-cornered apex in combination with the clearance between the toggle lever and actuator provides non-stall operation as these characteristics make it impossible to stall the toggle lever movement. The short step 32c in combination with the clearance between the toggle lever and the actuator, the energy storage in shear in the spring, the predetermined radius of the actuator tip and the thin section on the contactor at the fulcrum whereby the pivot-point is above the decision point, e.g., step 32c, afford non-tease operation as well as rapid transfer from one switch state to another and low bounce.

This switch is provided with full-throw momentary operation with the modification shown in FIG. 6. As shown therein, the switch is provided with a modified actuator 34 having a pair of slots 34a on opposite sides in which a pair of parallel spring-biased plungers 36 slide. These plungers 36 are retained in the actuator slots by the opposite side walls of the base. These plungers have T-shaped inner ends that engage abutments 34b on the actuator to limit the outward extension thereof under the force of helical compression springs 38. As will be apparent in FIG. 6, the actuator is constructed to accommodate another pair of like plungers for two-way momentary action but since this is a one-way momentary switch, a pair of short plunger ends 40 are used as abutments for the other ends of the compression springs and these plunger ends are entirely within the actuator slot 34a without extending outside thereof. Toggle lever 12 and spring 30 are similar to those hereinbefore described.

Figure 6B:
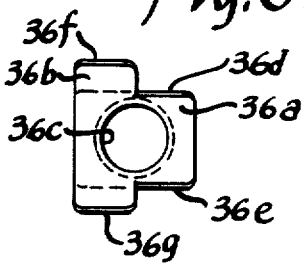
Figure 6A:
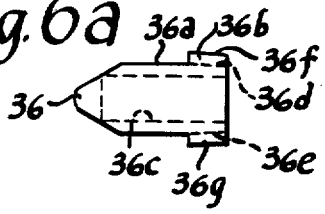

Momentary plunger 36 is provided with controlled clearance relative to actuator 34 that contributes to non-teasability and low bounce. As shown in FIGS. 6*a* and 6*b*, this plunger is provided with a slide portion 36*a* that slides within the slot 34*a* in the actuator and a T-shaped stop portion 36*b* that stops against abutment 34*b* of the actuator to limit the outward extension of the plunger. A blind hole 36*c* extends from the T-shaped rear end almost to the tip of this plunger to accommodate the bias spring 38. Because this plunger is carried by an actuator that rocks during its movement or moves in an arc rather than in a straight line, it is desirable to provide controlled clearance between this plunger and the actuator to prevent the plunger from sticking and to afford non-teasable operation and low-bounce. This controlled clearance is provided by tapered upper and lower sides 36*d* and 36*e* at the rear end portion of slide portion 36*a* as shown in FIGS. 6*a* and 6*b*. In addition, the T-shaped portion 36*b* is provided with upper and lower tapered surfaces 36*f* and 36*g*. As a result, this plunger can rock a small amount to release any sticking tendency as it engages and slides on the wall of the base.

As shown in FIG. 6, contactor 42 rests on the upper tip of terminal 8, there being no contactor support riveted to such tip as in FIG. 1. The contactor configuration for this ON-NONE-(ON) switch action, (ON) meaning momentary on, is as shown in FIG. 6. Thus, the right-hand ON end of the contactor has a configuration similar to that of the contactor in FIG. 1. The left-hand (ON) half of the contactor is provided with a "rise" portion 42*a* between the center pivot and the "drop" portion 42*b* near the left-hand contacting end thereof. This rise portion is engaged by the actuator when the toggle lever is operated to momentary (ON) position to close the contacts. The tip of the actuator stops just short of the rounded high point of this rise when the toggle lever is operated to momentary (ON) so that the contacts will be retained securely closed but will allow the momentary action plungers to return the switch to the other position when the toggle lever is released.

The center portion of contactor 42 is provided with a configuration shown in FIG. 6 to aid in its operation. This center portion has an upward curvature 42*c* with a sharper discontinuity 42*d* on its momentary (ON) side than the discontinuity 42*e* on its ON side. Also, the stall point of the actuator at both of these discontinuities is below the pivot point of the contactor, that is, where the contactor engages the upper tip of terminal 8. The area about discontinuity 42*e* will be referred to as energy storage area "A" and the area about discontinuity 42*d* will be referred to as energy storage area "B" because energy is stored as the actuator traverses these points to provide non-teasable action with low bounce as hereinafter described. The combination of (1) a pair of spring-biased plungers, (2) an actuator with conical spring, and (3) a contactor with energy storage areas provides a full-throw momentary switch with non-teasable action and low bounce and this occurs in energy storage area "A" due to the clearance between the toggle lever and the actuator hereinbefore described, the shear stress in the conical spring 30, the contactor rise 42*a*, the engagement of the momentary plungers with the wall of the base and the stall point being below the pivot point of the contactor as hereinbefore described.

This switch is provided with an ON-OFF-(ON) version with the modification shown in FIG. 7, (ON) meaning momentary ON. As shown therein, actuator 34 is provided with a pair of momentary plungers 36, bias springs 38 and plunger ends 40 as in FIG. 6. However, this version differs from FIG. 6 in that a contactor 26 and contactor support 24 like that in FIG. 1 are used to provide a stable OFF position at the center, a stable ON position at the right-hand side, and a momentary (ON) position at the left-hand side.

This switch is also provided with an (ON)-OFF-(ON) version shown in FIG. 8. This version differs from FIG. 7 in that a second pair of momentary plungers 44 are used in place of plunger ends 40. Therefore, the switch will have a stable OFF position at the center, a momentary (ON) position at the left-hand side and a momentary (ON) position at the right-hand side.

FIG. 9 and FIGS. 10–11 show two alternative modifications for obtaining ON-ON-ON operation if applied to the FIG. 1 version. FIG. 9 shows a contactor support 46 having one side 46*a* cut down to a lower level. This side 46*a* is low enough so that when used with contactor 26 of FIG. 1, it will allow the right-hand contacts to close in both the right-hand and center positions of the actuator. The left-hand contacts will close in the left-hand position of the actuator. Alternatively, the right-hand wings 26*g*′ of each pair thereof of the contactor may be cut-off as shown in FIGS. 10–11. As a result, when this contactor 26′ is used with contact support 24 in FIG. 1, the right-hand contacts will be closed in the right-hand and center positions of the actuator, and the left-hand contacts will be closed in the left-hand position of the actuator.

This switch is also provided with a 3-pole version shown in FIG. 12. This version is provided with a housing comprising a rectangular cup-shaped insulating base 50 molded of plastic material or the like and a metal cover 52 of aluminum or the like. This base is provided with three rows 54, 56 and 58 of terminals as shown in FIG. 12 with three terminals in each row arranged as in FIG. 1 or FIG. 5, for example, and molded in the bottom of the base, the center terminals 60, 62 and 64 being shown in FIG. 12. Contactors 66, 68 and 70 rest on the upper tips of the center terminals, respectively, and are engaged by actuators 72 and 80 for rocking movement to contact the upper tips of either end terminal in the respective rows when toggle lever 74 is operated in one direction or the other. This toggle lever is supported by a pivot pin 76 in the bushing 52*a* of cover 52 as in the FIG. 1 version and a gasket 78 is similarly assembled between the toggle lever and housing to seal the bushing against entry of unwanted matter.

This 3-pole actuator is of the self-leveling type, meaning that since there is, in addition to actuator 72 that actuates the two outer poles of the 3-pole switch, a center pole actuator 80 that is resiliently biased to actuate the center pole of the switch thereby to apply sufficient force on all three contactors for good electrical contact and to prevent any contact from hanging up that might occur in the absence of the self-leveling feature. As shown in FIG. 12, actuator 72 is provided with two tips 72*a* and 72*b* bearing down on contactors 66 and 70. Center pole actuator 80 has a tip 80*a* bearing down on contactor 68. This center pole actuator 80 is mounted in a center hole in actuator 72 for vertical sliding movement and is biased downwardly relative to actuator 72 by a helical compression spring 82. This center pole actuator is keyed into actuator 72 by a pair of opposite projections 80b and 80c slidably received in channels 72c and 72d at opposite sides of the hole in actuator 72. Toggle lever 74 has a stepped taper 74a at its lower end like that in the FIG. 1 version that is received into a tapered hole 80d in center pole actuator 80. A frusto-conical compression spring 84 biases actuator 72 downwardly with respect to toggle lever 74, the upper smaller diameter end of this spring being trapped below an annular ridge 74b around the toggle lever.

For one-way momentary action, actuator 72 will be provided with a pair of parallel plungers 86 and 88 confined in slots at opposite sides of actuator 72 by the inner walls of the base. These plungers are biased outwardly with respect to a pair of abutments in the form of plunger ends by respective compression springs in the same manner as shown in FIGS. 6 and 7. In order to illustrate these plungers in FIG. 12, the cross-sections of these plungers have been taken on a different plane from that of the remainder of the switch. For two-way momentary action, a second pair of like plungers would be used in place of the aforesaid plunger ends in the same manner as shown in FIG. 8.

This 3-pole double-throw switch shown in FIG. 12 is provided with means guiding the actuator as it is operated by the toggle lever. This means comprises a pair of flat downward projections 72e and 72f that are guided by channels 50a and 50b in the bottom of the base. As shown in FIG. 12, projection 72e and channel 50a are located about half-way between the left contacts and the center contacts whereas projection 72f and channel 50b are located substantially half-way between the center contacts and the right contacts. These guiding means maintain the actuators centered within the base as well as providing insulating barriers between the three poles of the switch. Otherwise, the three-pole switch base is constructed similarly to the double-pole switch base hereinbefore described including the grooves and arc barriers or shields integrally molded in the bottom of the base as hereinbefore described in connection with FIG. 1.

FIG. 13 shows an alternative means for securing the cover to the base. Rather than using a pair of separate metal cover ties as described in connection with FIG. 1, base 90 may be provided with integrally molded bosses or projections 90a that will snap into holes 92a in cover 92 skirts or tabs when the cover is assembled on the base. These projections 90a are then flattened as shown in broken line in FIG. 13 so that the lower side thereof abuts and presses against the lower edge of hole 92a in the cover skirt thereby to pull the cover snugly and tightly onto the base. This flattening of the projections may be done by heat forming, ultrasonic vibration or other known method.

FIG. 14 shows an alternative means for obtaining ON-OFF-ON operation as well as a modification thereof in broken line for obtaining ON-ON-ON operation. These means are alternative to the ON-OFF-ON version shown in FIG. 1 and the ON-ON-ON version shown in FIGS. 10 and 11.

Referring to FIG. 11, it will be apparent that the contactor pivot point 26h', that is, the indentation on the lower surface of wing 26a', is above the decision point 26j' on the contactor upper surface. This decision point is the point at which the contactor starts to rock as the actuator tip slides along the contactor. While this structural arrangement is most apparent in the enlarged view in FIG. 11, it is also present in the FIG. 1, 7 and 8 versions that use contactor 26 and contactor support 24. Under these conditions, the operating force for moving the actuator from one end of the contactor to the center is essentially one-half the force for moving the actuator from the center of the contactor to one end because the actuator tip "nests" in the central "valley" of the contactor. Nonetease operation of this contactor is obtained by this mechanical arrangement just described working together with a predetermined clearance between the lower end of the toggle lever and the walls of the tapered hole in the actuator hereinbefore described.

Referring now to the alternative structure in FIG. 14, it will be apparent that a similar mechanical arrangement is provided in combination with the clearance between the toggle lever and the actuator to afford nontease operation of the contactor. As shown therein, contactor 94 has its central side portions 94a sheared and formed upwardly to provide a pair of spaced indentations 94b and 94c at each side. Also, contactor support 96 is a U-shaped member riveted to the upper tip of terminal 8 and having at the upper end of each of its two sides a pair of spaced cusps or peaks 96a and 96b as shown more clearly in the enlarged view in FIG. 14a. Indentations 94b and 94c of the contactor rest on these peaks 96a and 96b to support the contactor for pivotal operation. These pivot points are above the decision points 94d and 94e as shown in FIG. 14a, these decision points being the points at which the contactor starts to rock as the actuator tip slides along the contactor. For ON-ON-ON operation, one peak at each side of contactor support 96 is cut off as shown by broken line 96c in FIG. 14a.

The switch may be provided with covers for different sizes of switches such as single-pole, double-pole, 3-pole, 4-pole, etc., by using a uniform size bushing 98 and a plurality of different sizes of cover portions 100, 102, etc., molded onto such uniform size bushings as shown in FIG. 15. Toggle lever 12 may be like those in the previously described versions. Gasket 100a will have a size suitable to fit cover portion 100 as will base 100b. Also, gasket 102a will have a size suitable to fit cover portion 102 as will base 102b. The periphery of the bushing base is provided with a reduced thickness rim portion 98a as shown in FIG. 15 about which cover portion 100 is molded to rigidly secure and retain the two parts together.

The terminal shown in FIG. 16 is a modification of that shown in FIGS. 3 and 4. Base 104 in FIG. 16 is molded of similar molding material such as general purpose phenolic. This base material has a larger temperature coefficient of expansion than the metal terminal 106. This terminal is round in cross-section at the portion embedded in the molded base rather than oblong as in FIGS. 3 and 4. This terminal has a stationary contact portion 106a at its upper end that is preferably reduced and rectangular in cross-section. A terminal portion 106b extends down below the base and has a hole 106c extending up thereinto for receiving an electrical wire connector. This terminal portion may have a desired cross-section and any desired configuration. To insure that the terminal remains sealed to the base, the round portion thereof that is embedded in the base is provided with two annular grooves 106d and 106e with the opposite sides of each groove diverging so that tight contact is maintained between the base and the terminal all around the terminal under temperature variations. For best sealing effect, this grooved portion of the terminal is provided with a shape of a parabola and the bump therebetween is also in the form of a parabola which may be defined as follows. There are two grooves 106*d* and 106*e* and a bump 106*f* therebetween. Each such groove has essentially the form of a parabola and the bump therebetween has essentially the form of a reversed parabola continuous between the two grooves such that the diverging sides of the grooves have straight portions. These straight portions such as 106*g*, for example, are tightly engaged by the plastic base at all times under temperature variations, similar to that hereinbefore described in connection with FIG. 3, thereby to maintain a good seal around the terminal.

While the apparatus hereinbefore described is effectively adapted to fulfill the objects stated, it is to be understood that the invention is not intended to be confined to the particular preferred embodiment of miniature sealed toggle switch disclosed, inasmuch as it is susceptible of various modifications without departing from the scope of the appended claims.

I claim:

1. A miniature environmentally sealed toggle switch adapted for mounting on a panel comprising:

a housing having a base provided with a contact compartment and a cover having a bushing for extending through a hole in the mounting panel;

stationary contacts in said compartment having terminals extending through said base to the outside;

a movable contactor supported on one of said stationary contacts serving as a pivot therefor and being rockable in opposite directions to engage and disengage at least one other stationary contact;

a toggle lever extending down through said bushing and means pivotally supporting said toggle lever in said bushing for pivotal movement limited by said bushing;

an actuator engaging said contactor and being slidable therealong to rock the same;

means coupling said toggle lever to said actuator comprising a hole in said actuator into which the inner end portion of said toggle lever extends and a frustoconical compression spring biasing said actuator against said contactor so that said actuator slides along said contactor and concurrently rocks in unison with said toggle lever as the latter is pivotally operated from one operating position to another;

and sealing means comprising a gasket hugging said toggle lever below its pivot and means stretching said gasket to the periphery of said base and said cover.

2. The miniature environmentally-sealed toggle switch claimed in claim 1, wherein:

said hole in said actuator is frusto-conical and inner end portion of said toggle lever is provided with a stepped taper to provide a large bearing surface therebetween through the toggle lever motion to minimize wear and thus provide constant operating characteristics such as feel and bounce throughout the long life of the switch.

3. The miniature environmentally-sealed toggle switch claimed in claim 1, wherein:

said toggle lever and said bushing of said cover are plated with good electrically conducting metal to insure grounding to said toggle lever through said bushing to the panel on which said switch is to be mounted thereby to avoid radiation of radio frequency interference.

4. The miniature environmentally-sealed toggle switch claimed in claim 1, wherein:

said contactor is provided with a "drop" adjacent to said other stationary contact effective on contactor opening to cause any arc present to move along said drop and thus away from the contacting area of said contactor to reduce erosion of the contactor surface thereby providing longer electrical life and maintaining the mechanical characteristics of "feel" and operating force.

5. The miniature environmentally-sealed toggle switch claimed in claim 4, wherein:

said base is provided with arc shield means between said other stationary contact and said one supporting stationary contact that functions with the arc gap provided by said drop to provide a "shadow" area that is shielded from direct impingement of arcing products thereby to maximize the insulating resistance between said stationary contacts.

6. The miniature environmentally-sealed toggle switch claimed in claim 5, wherein:

said arc shield means comprises a partition in the base in close proximity to said contactor between said stationary contacts.

7. The miniature environmentally-sealed toggle switch claimed in claim 6, wherein:

said arc shield means further comprises grooves in the bottom of said base on opposite sides of said partition.

8. The miniature environmentally-sealed toggle switch claimed in claim 7, wherein:

said contactor comprises a narrow section where it passes said partition and said partition hugs the opposite sides of said narrow section.

9. The miniature environmentally-sealed toggle switch claimed in claim 1, wherein:

said stationary contacts comprise a third stationary contact on the opposite side of said one supporting stationary contact from said other stationary contact;

said means coupling said toggle lever to said actuator comprises a predetermined clearance between said inner end portion of said toggle lever and the walls of said hole in said actuator;

and said contactor comprises a sharp apex at the center thereof in the path of said actuator which in combination with said clearance affords ON-NONE-ON operation with nonstall action.

10. The miniature environmentally-sealed toggle switch claimed in claim 1, wherein:

said stationary contacts comprise a third stationary contact on the opposite side of said one supporting stationary contact from said other stationary contact;

said means coupling said toggle lever to said actuator comprises a predetermined clearance between said inner end portion of said toggle lever and the inner surface walls of said actuator around said hole in said actuator;

said contactor comprises a low step at each side of the pivot thereof in the path of said actuator and a thickness at its center such that its pivot point is above such steps;

and said actuator comprises a tip of predetermined small radius relative to the height of said steps which in combination with said clearance, said steps and their relative location with respect to said pivot point, and the energy storage in shear in said frusto-conical actuator spring afford ON-NONE- ON operation with non-tease action, rapid contactor movement and low bounce.

11. The miniature environmentally-sealed toggle switch claimed in claim 1, wherein:

said actuator comprises a pair of spring-biased slidable momentary plungers extending therefrom to engage the inner wall of said base and slide there along as said actuator is swung by said toggle lever, said plungers having means providing controlled clearance with respect to said actuator;

said contactor comprises a hump of predetermined radius at the pivot thereof in the path of said actuator providing a discontinuity constituting an area storing energy as said actuator attempts to slide thereover, and the stall point of said contactor at said discontinuity being below said pivot;

said means coupling said toggle lever to said actuator comprises a predetermined clearance between said inner end portion of said toggle lever and the walls of said hole in said actuator;

said clearance between said toggle lever and said actuator, said contactor hump, the shear in said conical spring, said momentary plungers contact with the wall of said base, and said stall point being below said pivot providing a full-throw momentary switch that is non-teasable and has low bounce on momentary switch closure.

12. The miniature environmentally-sealed toggle switch claimed in claim 1, wherein:

said actuator comprises a pair of spring-biased slidable momentary plungers extending therefrom in one direction to engage the inner wall of said base and slide therealong as said actuator is swung by said toggle lever, said plungers having means providing controlled clearance with respect to said actuator;

said contactor comprises a depression at its pivotal center providing an OFF position therefor;

and said momentary plungers and said contactor depression providing a switch affording ON-OFF-(ON) operation.

13. The miniature environmentally-sealed toggle switch claimed in claim 12, wherein:

said actuator comprises a second pair of spring-biased slidable momentary plungers extending therefrom in the other direction to engage the opposite inner wall of the base to afford (ON)-OFF-(ON) operation.

14. The miniature environmentally-sealed toggle switch claimed in claim 1, wherein:

said contactor is provided with a configuration such that the pivot point thereof is above the decision point of the contactor where the actuator movement therealong first begins to rock said contactor;

and said means coupling said toggle lever to said actuator comprises a predetermined clearance between said inner end portion of said toggle lever and the walls of said hole in said actuator whereby non-tease ON-OFF-ON operation is provided.

15. The miniature environmentally-sealed toggle switch claimed in claim 1, wherein:

said supporting stationary contact comprises a contactor support having two pairs of spaced pivot points, one such pair for each side of said contactor;

and said contactor comprises a depression at its center between the pivot points of said pairs thereof which when engaged by said actuator maintains said contactor in OFF position thereby to provide a switch having ON-OFF-ON operation.

16. The miniature environmentally-sealed toggle switch claimed in claim 15, wherein:

said contactor support provides ON-ON-ON operation with minimum modification by removing one of said pivot points of each said pair thereof.

17. The miniature environmentally-sealed toggle switch claimed in claim 1, wherein:

said cover comprises a uniform size metal bushing and a plastic cover molded onto said bushing whereby said uniform bushing may be used with a plurality of different sizes of covers for single-pole, double-pole, 3-pole, etc. switches.

18. The miniature environmentally-sealed toggle switch claimed in claim 1, wherein:

said switch comprises additional stationary contacts and contactors providing a switch having more than two poles;

and said actuator comprises a double actuator integrally formed for operating two of said poles;

and a spring-biased additional actuator keyed into said double actuator for vertical movement for each additional pole of said switch.

19. The miniature environmentally-sealed toggle switch claimed in claim 18, wherein:

said double actuator comprises a vertical hole therein and vertical channels at opposite sides of said hole;

and said additional actuator comprises a member closely fitting into said hole for vertical sliding movement and a pair of projections keyed into said channels for nonrotatably guiding the same in said vertical movement.

20. The miniature environmentally-sealed toggle switch claimed in claim 1, wherein:

said base is molded with a boss on each of two opposite sides thereof;

said cover is provided with a tab on each of two corresponding opposite sides thereof having a hole therein, and said tabs closely embracing said base and said bosses entering said holes when said cover is assembled on said base;

and said bosses being thereafter flattened so as to press on the lower edges of said holes to pull said cover tightly onto said base.

* * * * *